US005462455A

United States Patent [19]

Reichle

[11] Patent Number: 5,462,455

[45] Date of Patent: Oct. 31, 1995

[54] MULTIPLE CONTACT PLUG HAVING ENCODING COMPONENTS INTERFITTABLE IN SELECTED POSITIONS

[75] Inventor: Hans Reichle, Wetikon, Switzerland

[73] Assignee: Reichle + De Massari AG, Wetzikon, Switzerland

[21] Appl. No.: 104,528

[22] Filed: Aug. 12, 1993

[30] Foreign Application Priority Data

Aug. 26, 1992 [CH] Switzerland ..... 02645/92

[51] Int. Cl.[6] ..... H01R 13/64

[52] U.S. Cl. ..... 439/681; 439/701

[58] Field of Search ..... 439/677, 680, 439/681, 701

[56] References Cited

U.S. PATENT DOCUMENTS

| | | | |
|---|---|---|---|
| 4,229,064 | 10/1980 | Vetter et al. . | |
| 4,345,813 | 8/1982 | Hatch | 439/681 |
| 4,820,204 | 4/1989 | Batty | 439/681 |
| 5,147,225 | 9/1992 | Kile et al. | 439/680 |
| 5,254,019 | 10/1993 | Noschese | 439/701 X |

FOREIGN PATENT DOCUMENTS

| | | |
|---|---|---|
| 0262432 | 4/1988 | European Pat. Off. . |
| 0477548 | 4/1992 | European Pat. Off. . |
| 2325174 | 4/1977 | France . |
| 3906421 | 9/1990 | Germany . |

*Primary Examiner*—Khiem Nguyen
*Attorney, Agent, or Firm*—Spencer, Frank & Schneider

[57] ABSTRACT

A modular multiple contact assembly includes a plug; a socket member having a socket opening for receiving the plug in a predetermined orientation; a first encoding sleeve securable to the plug; and a second encoding sleeve securable to the socket member. At least one of the first and second encoding sleeves is angularly and end-over-end placeable into a plurality of positions to bring into alignment different cross-sectional shapes of the first and second encoding sleeves. In a selected position one of the cross-sectional shapes of the first encoding sleeve matches with a cross-sectional shape of the second encoding sleeve, whereby in such a selected position the first and second encoding sleeves fit into one another to allow insertion of the plug into the socket opening.

11 Claims, 1 Drawing Sheet

MULTIPLE CONTACT PLUG HAVING ENCODING COMPONENTS INTERFITTABLE IN SELECTED POSITIONS

BACKGROUND OF THE INVENTION

The present invention relates to a modular multiple contact plug and/or a multiple contact socket of plug connection devices for signal current systems, in particular for telecommunications and data communications, with sleeve-like encoding means which prevent contacting between plug and socket in the event of nonconformity.

In signal current systems, in particular in the fields of telecommunications and data communications, there is the increasing problem of pluggably connecting the most diverse connecting systems such as telephone or on-line systems, computer systems and the like without causing wrong connections.

For this purpose encoding means are common which prevent the connection of plug and socket leading to contact in the event of nonconformity.

Such an arrangement has become known, for example, in published EU-patent application 0 477 548 where the encoding means comprise a component changing the geometrical cross section of the plug opening of the socket in accordance with the cross section of the insertion part of the plug to be used. Such components may be sleeve-like or may be only small plates or U-shaped yoke parts so as to achieve an adaptation of the plug opening of the socket to the respective geometrical cross section of the insertion part of the plug to be used.

SUMMARY OF THE INVENTION

These measures, however, lack sufficient technical sophistication and therefore it is an object of the invention to find a solution that leads to practically unlimited encoding possibilities and to a simple upgrade of the existing modular plugs and sockets.

In accordance with the invention this is achieved in that the sleeve-like encoding means for the plug is a component which is insertable on a modular plug in changeable circumferential (angular) and longitudinal (end-to-end) positions and having a cross section which is adaptable to the various geometrical cross sections of the plug openings of modular sockets by an appropriate selection of such position. In addition or as an alternative, the sleeve-like encoding means for the socket is a component which can be placed in front of the plug opening of a modular socket in changeable circumferential (angular) and longitudinal (end-to-end) positions and having an inner cross section adaptable to the different geometrical cross sections of modular sockets or plug encoding means by an appropriate selection of such position.

These measures enable an upgradable, easy-to-use, practically unlimited encoding of commercially available plug connecting devices with modular plugs and sockets.

In this respect the modular multiple contact plug may preferably be arranged in such a way that the plug encoding sleeve is nondisplaceably placed into a gripping part insertable on a plug, while the plug encoding sleeve is provided with encoding grooves and encoding designation shoulders extending in the plug-in direction, whereby the latter can at least partly be overlapped by tongues on the gripping part and whereby furthermore a catch gripping behind the inserted plug encoding sleeve is arranged on the free end of at least one tongue of the gripping part.

The multiple contact socket is preferably arranged in such a way that the socket encoding sleeve is nondisplaceably seated in a gripper-like fixing device projecting away from the front side of the socket and that the socket encoding sleeve is provided with grooves extending in the plug-in direction, carrying encoding designations and used for receiving the projecting tongues of the gripper-like fixing device. The grooves are at least partly overlapped by the tongues, and on the free end of at least one tongue of the gripper-like fixing device there is a catch gripping behind the inserted socket encoding sleeve. The arrangement of the multiple contact socket may be such that the socket encoding sleeve comprises inwardly projecting cam parts designated for the cooperation with the encoding grooves of the socket encoding sleeve.

BRIEF DESCRIPTION OF THE DRAWING

Exemplary embodiments of the subject matter of the invention are explained in greater detail below by reference to the accompanying drawings, wherein.

DETAILED DESCRIPTION OF THE PREFERRED EMBODIMENTS

Figure 1:
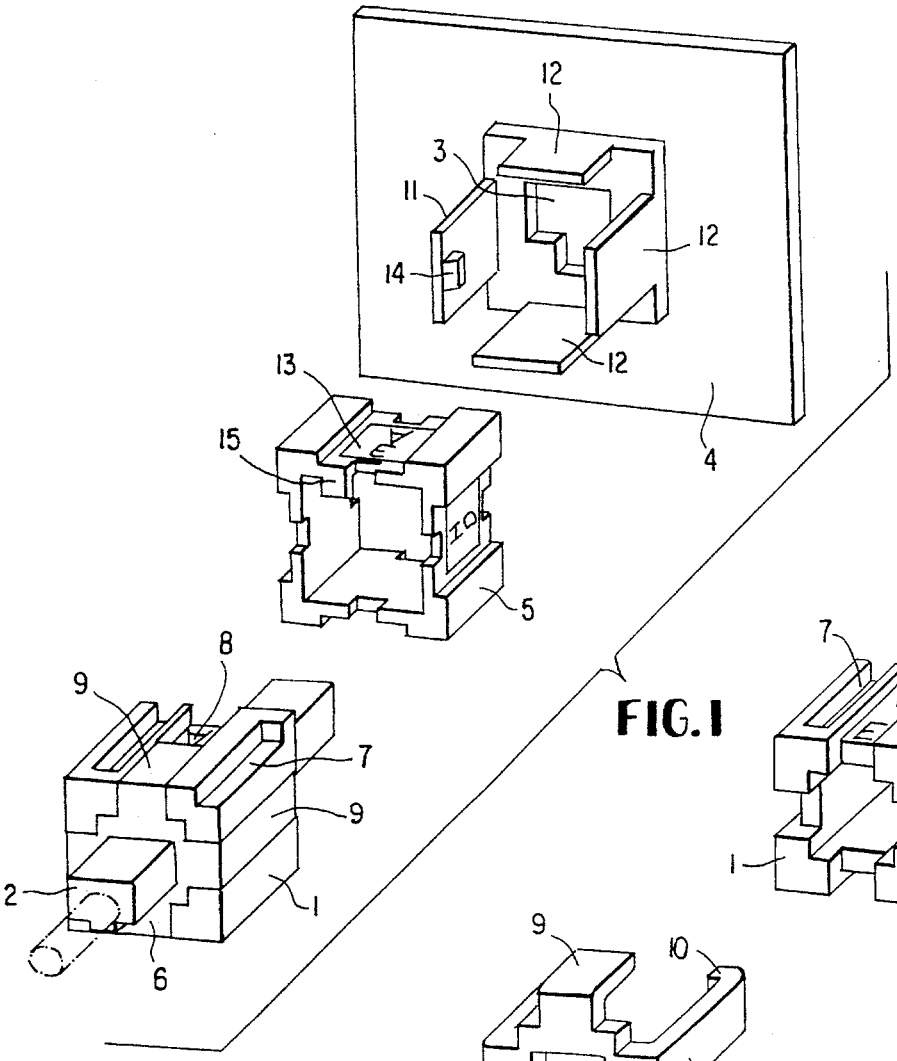
FIG. 1 is an exploded perspective view of a plug connection device having a socket, a sleeve-like encoding component and an encoded plug in accordance with the invention.

The plug connection device in accordance with the invention as shown in FIG. 1 comprises a modular multipolar socket which is indicated here by front plate 4 and plug opening 3 as well as a modular multiple contact plug 2 of common arrangement, whereby sleeve-like encoding means prevent the connection leading to contact between plug 2 and socket 3,4 in the event of nonconformity.

For this purpose the sleeve-like encoding means 1 for the plug 2 is a component insertable on a modular plug 2 in changeable circumferential (angular) and longitudinal (end-to-end) positions. The encoding means 1 has a cross section which, by appropriate positioning, is adaptable to the varying geometrical cross sections of the socket opening 3 of the front plate 4.

Figure 2:
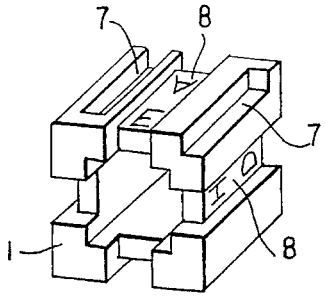
FIGS. 2 and 3 are perspective views of the encoding means for a modular plug in accordance with FIG. 1.
Figure 3:
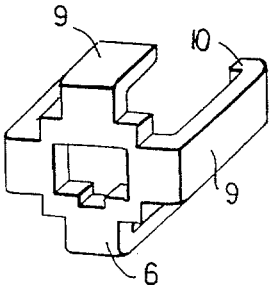

As is shown in FIGS. 2 and 3 in greater detail, the plug encoding sleeve 1 is fixedly attached against displacement in a gripping part 6 which is insertable on the plug 2. For this purpose the plug encoding sleeve 1 is provided with encoding grooves 7 extending in the plug-in direction and encoding designation shoulders 8. The latter can at least partly be overlapped by tongues 9 on the gripping part 6. Furthermore, it is preferable to provide at the free end of at least one tongue 9 of the gripping part 6 a catch 10 gripping behind the inserted plug encoding sleeve 1.

It is a further feature of the invention in accordance with FIG. 1 that the sleeve-like encoding means 5 for the socket 3,4 is a component which can be placed on the socket opening 3 of a modular socket 4 in selected circumferential (angular) and longitudinal (end-to-end) positions. The encoding means 5 has an inner cross section adaptable to the different geometrical cross sections of modular sockets or plug encoding means 1 by the appropriate positioning. It is preferable if the socket encoding sleeve 5 is fixedly placed against displacement in a gripper-like fixing device 11 projecting from the front side of socket plate 4 and is provided with grooves 13 extending in the plug-in direction, carrying encoding designations and used for receiving projecting tongues 12 of the gripper-like fixing device 11. The grooves 13 are at least partly overlapped by the tongues 12.

For the purpose of achieving a simple assembly the arrangement is such that on the free end of at least one tongue 12 of the gripper-like fixing device 11 there is a catch 14 gripping behind the inserted socket encoding sleeve 5. Furthermore, the socket encoding sleeve 5 comprises cam parts 15 projecting inwardly and used for cooperating with the encoding grooves 7 of the plug encoding sleeve 1.

Figure 4:
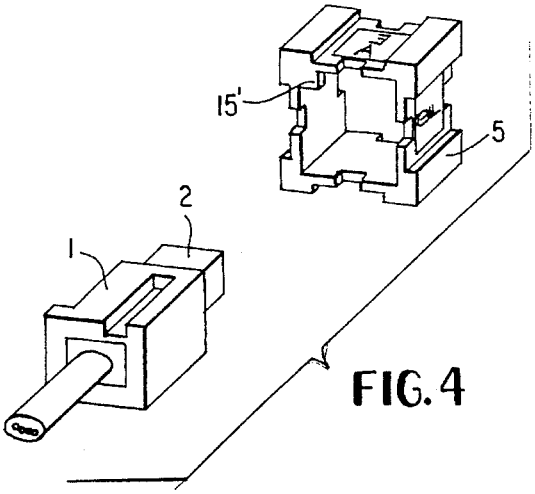
FIG. 4 is an exploded perspective view of an embodiment of a sleeve-like encoding component for a socket and an encoded plug associated therewith in accordance with FIG. 1.
Figure 5:
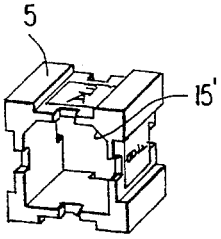
FIG. 5 is a perspective view of an embodiment of a sleeve-like encoding component for a modular socket in accordance with FIG. 1.

FIG. 4 (in conjunction with a correspondingly encoded plug 2) and FIG. 5 show embodiments of cam parts 15' in a socket encoding sleeve 5.

It is seen from the above description that the encoding means in form of sleeves in the modular multiple contact plug or in the multiple contact socket or in both simultaneously allow a virtually unlimited number of encoding options. Furthermore, the construction of such plug contact devices is extremely simple and all commercially available plugs and sockets of the type mentioned above can be upgraded (retrofitted) with this system.

A number of modifications are possible within the scope of the invention. For example, additional plates or the like (not shown) can be used for adaption to the geometrical cross section.

While there are shown and described preferred embodiments of the invention, it is to be distinctly understood that the invention is not limited thereto but may be embodied and practised within the scope of the following claims.

What I claim is:

1. A modular multiple contact assembly comprising a plug; a socket member including a socket opening for receiving the plug in a predetermined orientation; a first encoding sleeve; first securing means for securing said first encoding sleeve to said plug; a second encoding sleeve; and second securing means for securing said second encoding sleeve to said socket member; at least one of said first and second encoding sleeves being angularly and end-over-end placeable into a plurality of positions to bring into alignment different cross-sectional shapes of said one encoding sleeve with the other of said first and second encoding sleeves; in a selected one of said positions one of said cross-sectional shapes matching with a cross-sectional shape of said other encoding sleeve, whereby in said selected position said first and second encoding sleeves fitting into one another to allow insertion of said plug into said socket opening.

2. The modular multiple contact assembly as defined in claim 1, wherein said at least one of said first and second encoding sleeves is said first encoding sleeve secured to said plug.

3. The modular multiple contact assembly as defined in claim 2, wherein said first securing means comprises gripping parts immobilizing said first encoding sleeve insertable on said plug.

4. The modular multiple contact assembly as defined in claim 3, wherein said first encoding sleeve includes coding grooves extending in a direction of insertion of said plug into said socket opening and encoding designation shoulders; said gripping parts comprising tongues at least partially covering said shoulders.

5. The modular multiple contact assembly as defined in claim 4, further comprising a catch arranged at a free end of at least one of said tongues; said catch gripping behind said first encoding sleeve inserted on said plug.

6. The modular multiple contact assembly as defined in claim 1, wherein said at least one of said first and second encoding sleeves is said second encoding sleeve secured to said socket member.

7. The modular multiple contact assembly as defined in claim 6, wherein said second securing means comprises grippers mounted on and projecting from said socket member; said grippers immobilizing said second encoding sleeve on said socket member.

8. The modular multiple contact assembly as defined in claim 7, wherein said second encoding sleeve comprises grooves extending in a direction of insertion of said plug into said socket opening said grooves carrying coding designations; said grippers including tongues projecting from said socket member and being received in said grooves; said tongues at least partially covering said grooves.

9. The modular multiple contact assembly as defined in claim 8, further comprising a catch arranged at a free end of at least one of said tongues; said catch gripping behind said second encoding sleeve.

10. The modular multiple contact assembly as defined in claim 6, wherein said first encoding sleeve includes coding grooves extending in a direction of insertion of said plug into said socket opening; further wherein said second encoding sleeve has an inwardly extending cam part cooperating with one of said coding grooves of said first encoding sleeve.

11. A modular multiple contact assembly comprising a plug; a socket member including a socket opening for receiving the plug in a predetermined orientation; a first encoding sleeve; first securing means for securing said first encoding sleeve to said plug; a second encoding sleeve; and second securing means for securing said second encoding sleeve to said socket member; said first and second encoding sleeves being angularly and end-over-end placeable into a plurality of positions relative to said plug and said socket member, respectively, to bring into alignment different cross-sectional shapes of said first encoding sleeve with different cross-sectional shapes of said second encoding sleeve; in a selected one of said positions one of said cross-sectional shapes of said first encoding sleeve matching with a cross-sectional shape of said second encoding sleeve, whereby in said selected position said first and second encoding sleeves fitting into one another to allow insertion of said plug into said socket opening.

* * * * *